US006827087B2

(12) United States Patent
Wanna et al.

(10) Patent No.: US 6,827,087 B2
(45) Date of Patent: Dec. 7, 2004

(54) CIGARETTE WITH BURN RATE MODIFICATION

(76) Inventors: Joseph T. Wanna, 134 Springwood Ct., Macon, GA (US) 31210; Douglas R. Hicks, 3000 Edgewater Point, McDonough, GA (US) 30253

( * ) Notice: Subject to any disclaimer, the term of this patent is extended or adjusted under 35 U.S.C. 154(b) by 35 days.

(21) Appl. No.: 10/299,231

(22) Filed: Nov. 19, 2002

(65) Prior Publication Data

US 2004/0094171 A1 May 20, 2004

(51) Int. Cl.[7] ..... A24D 1/02
(52) U.S. Cl. ..... 131/365; 131/349
(58) Field of Search ..... 131/365, 349

(56) References Cited

U.S. PATENT DOCUMENTS 3,165,105 A 1/1965 Campbell
3,526,231 A 9/1970 Verbakel
4,336,812 A 6/1982 Seragnoli
4,739,775 A * 4/1988 Hampl, Jr. ..... 131/365
5,156,169 A 10/1992 Holmes et al.
5,169,481 A 12/1992 Braunshteyn et al.
5,200,020 A 4/1993 Collins et al.
5,244,530 A * 9/1993 Collins et al. ..... 156/519
5,398,702 A 3/1995 Belvederi
6,129,087 A 10/2000 Wallace et al.
6,142,154 A 11/2000 Dall'Osso et al.
6,606,999 B2 * 8/2003 Crooks et al. ..... 131/365
2002/0185143 A1 12/2002 Crooks et al.

* cited by examiner

*Primary Examiner*—Dionne A. Walls
(74) *Attorney, Agent, or Firm*—John F. Salazar; Middeton Reutlinger

(57) ABSTRACT

A cigarette with burn rate modification is described. The cigarette has a partial double wrap design and incorporates an inner wrap material which extends partially around the interior portion of the outer wrapper of a cigarette. The inner wrap can be a single element or can be a plurality of strips which extend coaxially along the tobacco column and which affect the burn rate of the cigarette. The partial inner wrap material exhibits a low porosity and forms zones of high diffusion and low diffusion along the length of the tobacco rod. These zones may be singular or may be alternating and are coaxial. The low diffusion zones are aligned with the inner wrap material.

24 Claims, 5 Drawing Sheets

CIGARETTE WITH BURN RATE MODIFICATION

TECHNICAL FIELD

The present invention relates to a cigarette having a modified burn rate. The modifications to the cigarette of the present invention include changes to the wrapper of the cigarette paper such that the tobacco column of the cigarette is adjacent to a strip wrap forming co-axial zones of high diffusion areas and co-axial zones of low diffusion areas. Such a partial double wrap cigarette exhibits a modified burn rate such that the standard smolder rate of the cigarette may be changed as desired to either self extinguish or slowed significantly depending upon the desired outcome.

DETAILED DESCRIPTION OF THE PREFERRED EMBODIMENTS

Figure 1:
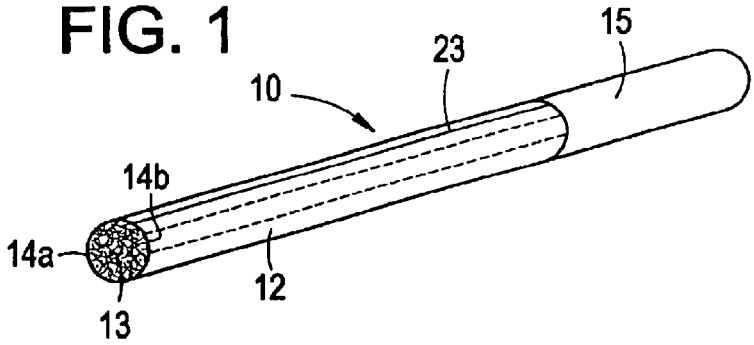
FIG. 1 is a perspective view of the partial double wrap cigarette with modified burn rate of the present invention.

A cigarette with burn rate modification is shown in FIG. 1 and may be described as a partial double wrap cigarette 10. As seen therein, the partial double wrap cigarette 10 of the present invention incorporates a standard column of tobacco 13 which extends from an exposed end to the filter 15. Circumscribing the tobacco column 13 is the outer wrap of the cigarette paper 12. Interior of the outer wrap cigarette paper 12 is a separate partial inner wrap layer or strip 14*a* and 14*b*. The separate partial inner wrap layer 14*a* and 14*b* acts as a burn rate modifier for the tobacco column 13 by altering the burn characteristics of the cigarette 10. As can be seen from the embodiment shown in FIG. 1, the inner wrap layer strips may be co-axial to the tobacco column 13 and may extend substantially the length of the tobacco column from the exposed end to the filter 15. By insertion of the separate partial inner wrap layer 14*a* and 14*b* which in this embodiment extends co-axial to the tobacco column 13, modification may be made to the burn rate of the cigarette in such a manner that the burn rate may be adjusted depending upon the packing density of the tobacco, porosity of the outer wrap paper 12 and additives to the outer wrap, width of the separate partial inner wrap layer 14*a* and 14*b*, porosity of the inner wrap layers 14*a* and 14*b*, and additives to the inner wrap strips. Alternatively, the inner wrap layer may be shortened to not extend the full length of the tobacco column 13 or may extend in varying directions. Thus, many alterations to the burn rate of the partial double wrap cigarette 10 of the present invention may be established based upon the combination of factors noted herein, among others.

As depicted in FIG. 1, the partial double wrap cigarette 10 of the present invention which has a modified burn rate characteristic incorporates an outer wrap paper 12 with a first and a second separate partial inner wrap strip 14*a* and 14*b*. The outer wrap cigarette paper 12 may be a normal porosity paper which typically exhibits a porosity of 15–80 Coresta units. In combination with the outer wrap cigarette paper 12 is positioned at least one partial inner wrap layer which can modify the burn rate characteristics of the cigarette 10. As shown, a first and a second partial inner wrap layer 14*a* and 14*b* are provided on opposite sides of the tobacco column 13. In order to provide substantially equivalent burn rate characteristics along the entirety of the tobacco column 13, the partial inner wrap strips 14*a* and 14*b* may substantially extend and be co-axial with the tobacco column 13 to the filter 15.

Figure 4:
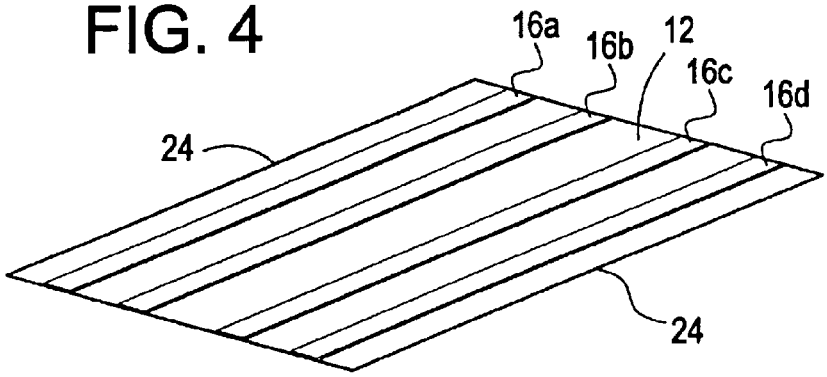
FIG. 4 is a perspective view of the partial double wrap for a cigarette with modified burn rate of the present invention.

As depicted in the embodiment of FIG. 4, the partial inner wrap layers 14*a* and 14*b* extend from end to end of the tobacco column 13 and may be positioned such that they are either equal distant from each other or may be placed in alternative positions based upon the desired burn rate characteristics.

Figure 3:
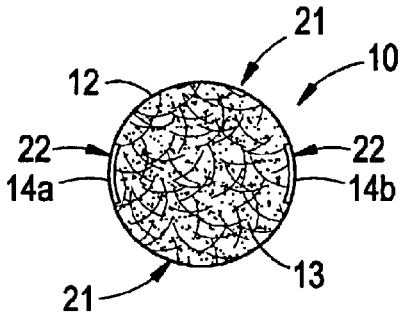
FIG. 3 is an end view of the cigarette with modified burn rate of the present invention.

Turning to FIG. 3, it is apparent that the partial double wrap cigarette 10 of the present invention has alternating high diffusion areas 21 and low diffusion areas 22 based upon the placement of the inner wrap layers or strips 14*a* and 14*b*. As can be seen, the high diffusion areas 21 of which there is at least one, allow for increased permeation of CO and oxygen gases through the barrier formed by the outer wrap 12 while maintaining normal deliveries. In combination, low diffusion areas 22 which are defined by the circumferential extent of each of the partial inner wrap layers 14*a* and 14*b* may potentially block a significant portion or all of the inflow and outflow of gases therethrough related directly to the porosity of the inner wrap layer 14*a* and 14*b* in combination with the outer wrap layer 12. The co-linear zones of high diffusion area 21 and low diffusion area 22 may exhibit a porosity of greater than 14 Coresta for the co-linear high diffusion areas and less than 8 Coresta for the co-linear low diffusion areas.

Figure 2:
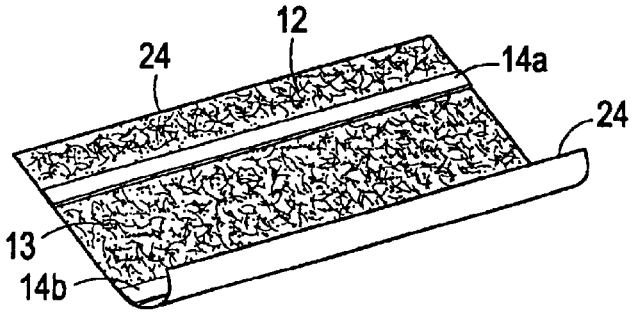
FIG. 2 is a perspective view of the unrolled cigarette paper of the unrolled outer wrapper of the cigarette having a partial double wrap with modified burn rate as shown in FIG. 1.

As shown in the drawings, the construction of the cigarette with burn rate modification is a partial double wrap cigarette 10 depicted herein and utilizes a standard outer wrap cigarette paper 12 which, in a typical cigarette, is 27 mm wide. Placed along the interior of the outer wrap, as shown in FIG. 2 and in FIG. 4 in an alternative embodiment, is located the separate partial inner wrap layer 14*a* and 14*b* which may substantially extend along the length of the outer wrap 12. While the outer wrap of the cigarette paper may be standard porosity and construction, the partial inner wrap of this embodiment has a first and a second strip 14*a* and 14*b* each of which may be 4 mm in width and which may have a porosity of less than 8 Coresta units. Therefore, combined, the two inner wrap layers or strips 14*a* and 14*b* may circumscribe about 8 mm of the circumference of the partial double wrap cigarette 10 of the present invention but may extend around a circumference of up to 15 mm of the tobacco column in relation to a standard cigarette dimension. Any combination of the partial inner wrap and outer wrap may work depending on the variables noted, such as porosity of each paper, but it is felt that good burn rate characteristics as well as limited effects to smoke characteristics and flavor may be achieved by incorporating an inner wrap which covers less than about 75% or preferably less than about 60% and even more preferably less than about 35% of the circumference of the outer wrap. This is a function of the overall cigarette and may vary depending on the circumference of the outer wrap. However, variations are available to achieve the same favorable results utilizing the inventive aspects of the present design and such descriptions are not felt to be limiting and are exemplary only.

Alternatively, many different constructions may be utilized to provide the cigarette with burn rate modification as set forth herein. As may be understood, a single inner wrap layer or a plurality of inner wrap layers may be provided based upon the desired characteristics and burn rate modification. Thus, as previously mentioned, combinations of low porosity inner wrap segments and higher porosity outer wrap segments may be utilized to provide various linear burn rates which may be desirable. Thus, a typical linear burn rate of 6.0 mm per minute may be reduced as desired based upon a combination of porosity of outer wrap and partial inner wrap strips among other factors and may readily be reduced to below 4 mm/minute if needed. This includes formulation of single inner wrap strips of lower porosity or replacement of the inner wrap strips with various construction material including reconstituted tobacco, low porosity paper, bandcast tobacco, a polymer based material, other paper or material. The inner wrap strips may be coated with burn modifiers or other materials which would create at least one low diffusion area along the tobacco column. The paper may be coated with, as an example, sodium alginate as a burn inhibitor in order to decrease the porosity of the paper and provide adequate characteristics such that the entire combination of outer wrap porosity, tobacco packing density, inner wrap circumference covered and number of strips, inner wrap porosity and other factors cause the cigarette to exhibit a desired burn rate.

As shown in FIGS. 4–7, various embodiments may be utilized in order to create the low porosity zone. As depicted in FIG. 4, the opened standard outer wrap 12 is lined with a plurality of inner wrap or inner layer strips 16*a*, 16*b*, 16*c* and 16*d*. These strips may be placed equidistantly apart along the interior of the outer wrap 12 and positioned away from the edges or seam where the outer wrap is adhered to itself during rolling within the garniture of the cigarette maker. As depicted, the strips 16*a*–16*d* may all be fed into the garniture and incorporated on the interior of the outer wrap adjacent the tobacco column. Placement of the partial inner wrap strips modifies the burn rate to a desired level such that the rate may be decreased sufficiently to cause either a significantly reduced static burn rate or self-extinguishment at a desired interval.

Figure 5:
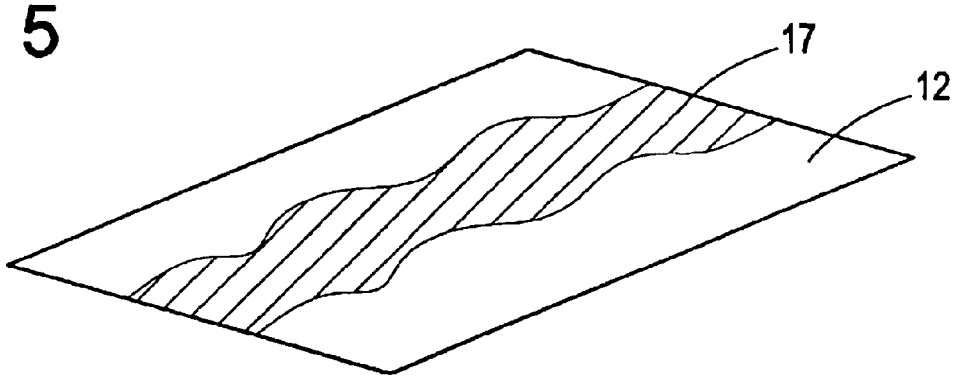
FIG. 5 is an alternative embodiment for a partial double wrap design for the present invention.

As shown in FIG. 5, an inner layer with non-linear sides 17 as compared to the edges of the outer wrap 12 may be utilized as the partial inner wrap in order to create the low porosity zone. As shown therein, the inner wrap layer 17 may have be in wave form so that the placement of the low porosity zone changes in position along the tobacco column axis. Such non-linear placement of the low porosity zone may allow for different positioning of the cigarette during static burn and insure that the desired static burn rate takes effect regardless of the position of the cigarette.

Figure 6:
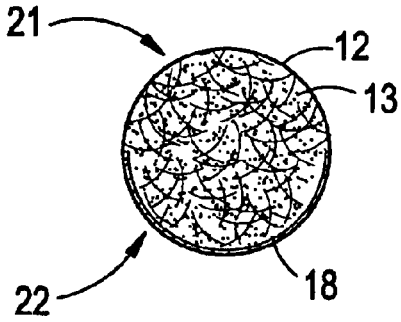
FIG. 6 is a front view of an alternative embodiment for the cigarette with burn rate modification of the present invention.

Depicted in FIG. 6 is another embodiment of the cigarette with burn rate modification of the present invention. As seen therein, a high diffusion area 21 and low diffusion area 22 is defined by addition of a partial double wrap inner wrap layer 18 which circumscribes a portion of the tobacco column 13 on the interior of outer wrap 12. The partial inner wrap layer 18, as depicted in the figure, extends approximately half way around the perimeter of the tobacco column 13. However, many different configurations may be utilized in order to achieve the appropriate linear burn rate through the burn rate modification set forth. The partial double wrap inner wrap layer 18 may be comprised of standard cigarette paper which has a low porosity of less than 7 Coresta units or cigarette paper coated with burn rate modifiers, or may be alternative construction such as a bandcast tobacco sheet with or without additives and which typically has a low Coresta unit value, typically less than 5 and more preferably less than 3. A secondary benefit of utilizing bandcast or reconstituted tobacco sheets as the partial double wrap inner wrap layer 18 is that the coloring of the inner wrap may be such that it is similar to the tobacco column 13 and does not provide a contrastly whitened area which extends along the low diffusion area 22. Additionally, a polymer film or other material may be used as the partial double wrap inner wrap layer 18. It may be preferable for the partial double wrap inner layer displayed in FIG. 6 to be 2–14 mm in width or alternatively, less than 75% of the circumference of the outer wrap in order to obtain the appropriate burn rate modification desired wherein the linear burn rate is sustained at a low enough level, preferably below 4.0 mm per minute.

Figure 7:
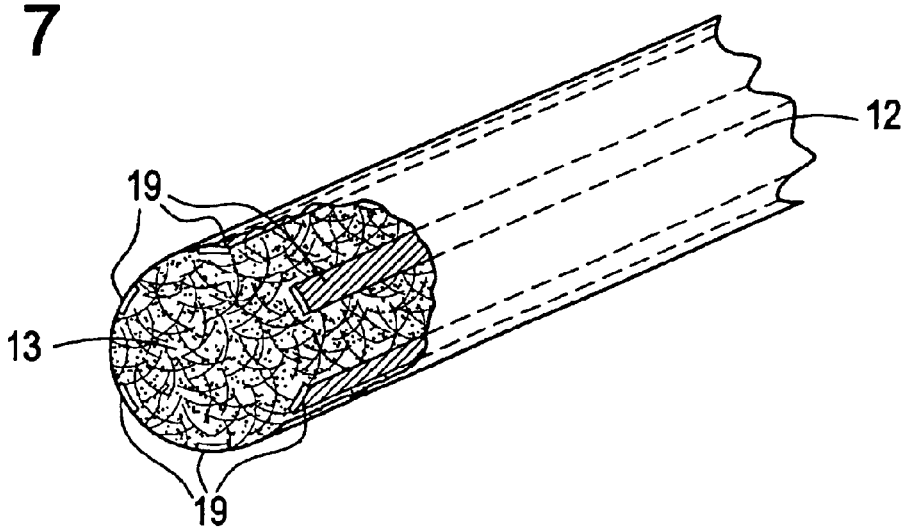
FIG. 7 is a partial cut away view for an alternative embodiment of the cigarette with burn rate modification of the present invention.

As depicted in FIG. 7, an alternative embodiment is disclosed wherein a plurality of inner wrap strips 19 are utilized substantially surrounding the tobacco column 13 on the interior of the outer wrap 12. The plurality of inner wrap strips 19 may be fed into the garniture adjacent the outer wrap 12 and encircling the tobacco column 13 as it is formed within the cigarette maker. The plurality of strips 19 may be comprised of a low porosity cigarette paper individually fed into the cigarette maker or by a single or multiple strips fed into the cigarette maker adjacent to the garniture and cut to the appropriate strip widths. As depicted in FIG. 7, a plurality of inner wrap strips 19 are utilized and extend co-axially substantially along the length of the tobacco column 13. Preferably, the plurality of strips 19 extend along the entire tobacco column length such as to modify the burn rate along the entire tobacco column regardless of cigarette positioning. It is felt that by providing a plurality of strips 19 as depicted in FIG. 7, a more even modification of the burn rate of the cigarette may be produced.

As may be appreciated, extending the inner wrap layer substantially along the length of the tobacco column 13 such that they are co-axial provides a significant benefit over alternating rings which are perpendicular to the axis of the tobacco column 13. Such perpendicular rings which alternate along the length of the tobacco column may provide a non-linear burn rate of the tobacco column 13. Thus, in such a design where there are circumscribing rings around the tobacco column, the linear burn rate becomes variable between a low linear burn rate to a high linear burn rate depending upon the porosity of the paper at the point of the rings as opposed to the porosity of the non-adjusted paper between the rings. Such non-linear burn rate may in fact be undesirable in that continued free burning of the tobacco column between the rings for significant periods of time does not produce an appropriate burn rate modification which can be depended upon through the entire tobacco column length. Further, at points where the low porosity rings are present, a smoker may puff on the cigarette as the burning of the tobacco column passes over a low porosity ring. At such a point, it is thought that the deliveries of the cigarette may be altered significantly to increase the CO and other compounds provided as the cigarette burns over one of these rings. Thus, the partial double wrap inner layer of the present invention overcomes these problems by providing known standard deliveries over the entire length of the tobacco column while also modifying the burn rate along the entire co-axial length.

In the design of the cigarette with the burn rate modification 10 of the present invention, it may be desirable to incorporate the inner wrap layers, whether a plurality of strips or a single layer, away from the seam of the outer wrap 12. As is known in cigarette manufacturing, the seam 23, depicted in FIG. 1, is formed by the maker by over-wrapping the side edges 24 of the outer wrap 12. In typical cigarette manufacturing, an adhesive is applied along one of the edges 24 prior to folding of the outer wrap and formation of the tobacco column 13. During manufacturing of the cigarette with burn rate modification 10 of the present invention, it is desirable to maintain the partial inner wrap layer away from the seam portion to assure that the outer wrap 12 is properly formed and the partial inner wrap layer does not intercede in the formation of the tobacco column or adhesive of the outer wrap layer. Thus, as depicted in the embodiments, the partial inner wrap layers are shown to be placed away from the side edges 24 so that the inner wrap portions will not interfere with the seam of the outer wrap 12 nor interfere with the formation of the tobacco column within the garniture in a typical cigarette manufacturing machine. Thus, the cigarette with burn rate modification of the present invention may be implemented on standard cigarette making machines with only minor modifications made to the paper feeding devices and no modifications therefore will necessarily be required within the garniture. It is also apparent that in any of the embodiments shown herein the strips may be alternatively placed on the exterior of the cigarette and retained on the wrapper by adhesives or other means so that there are still formed co-linear zones of high and low porosity.

Figure 8:
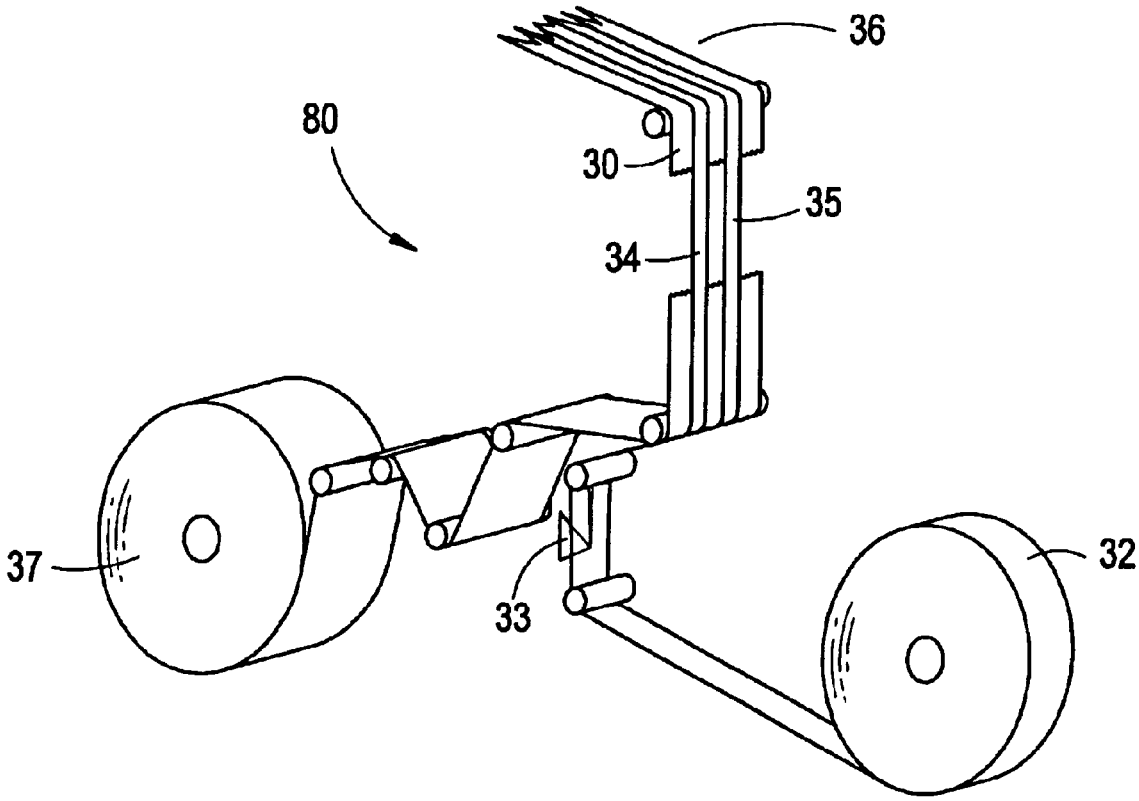
FIG. 8 is a perspective view of the cigarette paper feeder on a cigarette making machine for use with the present invention.

As shown in FIG. 8, a sample design for manufacturing a cigarette with burn rate modification described herein is depicted. The paper feeding assembly 50 is comprised of two paper sources, the outer wrap bobbin 37 and the inner wrap or inner strip bobbin 32. The outer wrap bobbin 37 may be comprised of standard porosity outer wrap cigarette paper having a standard width which may vary between 19–27 mm as may be normally the case and may be fed to the cigarette making machine through a plurality of rollers and tensioning guides. In the embodiment shown, the partial inner wrap and outer wrap layer may be combined to form a combined cigarette paper 36 wherein the outer wrap and inner wrap layer receive the tobacco within the garniture. The outer wrap layer 30 may underlie the partial inner wrap strips 34, 35 which are fed from the inner wrap strip bobbin 32 or other source. The inner wrap strip bobbin 32 may be narrower than the outer wrap as it is intended to cover only a portion of the inner surface of the outer wrap 30. The inner wrap strip bobbin 32 may be unrolled and fed through rollers and cut by a knife into the desired strips prior to forming the combined cigarette paper 36 just preceding the garniture. The strips 34, 35 which form the inner wrap portion of the cigarette of the present invention may have significantly different burn rate characteristics than the outer wrap 30. Thus, variations in the porosity, content and other characteristics may be provided by supplying dual bobbins at the machine in the present embodiment 50. The slitter 33 may be provided to slit the inner wrap paper into two or more strips.

As shown in FIG. 8, the inner wrap strip bobbin 32 may have a paper with a width of 4–15 mm which is slit in two strips. The correct combination of porosity and burn characteristics of the inner wrap and outer wrap layer may be adjusted so as to produce an appropriate burn rate modification which is desirable to produce a standard linear burn rate throughout the entirety of the cigarette and tobacco column.

As shown in FIG. 8, the paper feeding assembly 50 disclosed incorporates a number of tensioning rollers for providing adequate feeding of the outer wrap 30 and the partial inner wrap strips 34, 35 to produce the combined cigarette wrapping paper 36. As may be appreciated, the smaller width bobbin 32 creates significantly more problems in feeding the slit paper to the garniture. Adequate tensioning of the strips 34, 35 must be provided in order to prevent tearing of the inner wrap strips 34, 35 prior to the garniture. Additionally, as cigarette manufacturing process is inherently a stop and go procedure, the proper tensioning of the outer wrap bobbin 37 and inner wrap strip bobbin 32 is necessary. Thus, the partial inner wrap strips 34, 35 may be combined with the outer wrap paper 30 just prior to the garniture or may be combined, as depicted in FIG. 8, immediately after slitting in order to provide proper tensioning and combination of the two layers.

Figure 9:
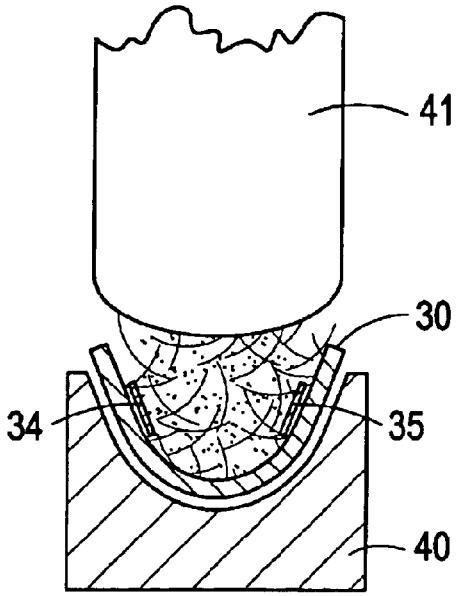
FIG. 9 is an end sectional view of the garniture area of a cigarette making machine for use with the present invention.

Turning to FIG. 9, a cross section of the garniture within the cigarette maker is shown. The garniture 40 is the area within the cigarette maker wherein the cigarette is rolled and formed. There is usually a belt which lies between the outer wrap 30 and the garniture 40 but which is not shown herein for explanation purposes. As depicted, the garniture 40 has a curvature for formation of the tobacco column and cigarette. The curvature folds the outer wrap 30 around the tobacco after the tobacco is deposited by the tobacco provider 41 within the cigarette maker. Prior to entry within the garniture, the inner wrap strips 34, 35 are mated with the outer wrap 30 so that the combined cigarette wrapper 36 is folded and formed with the tobacco while the cigarette wrapper formation is already in place. Such a design allows for the flexibility of combining various characteristics of the outer wrap layer and the partial inner wrap layer. Another benefit of the inline formation and processing of the cigarette with burn rate modification of the present invention is that it is an online method which does not affect the speed or formation of the actual cigarette. Thus, within the garniture, there is no significant modification required to form the cigarette rod which is cut into proper length and then added to filters at a later station within the cigarette maker.

As shown in FIG. 9, the inner wrap strips 34, 35 are fed into the garniture on the interior surface of the outer wrap 30 such that they are in proper placement when the cigarette maker forms the cigarette and tobacco column. In the present example, as shown in FIG. 3, the inner wrap strips 34, 35 are positioned at 90° from the seam of the outer wrap 30 and may be placed equidistant from each other in order to provide a smooth and continuous burn rate modification for the cigarette. The inner wrap material may be placed on the interior side of the outer wrap 30 without adhesive as preferred but other position maintaining material may be used. Formation of the cigarette within the garniture 40 and compacting of the tobacco into the tobacco rod maintains the placement of the inner wrap strips 34, 35.

Figure 10:
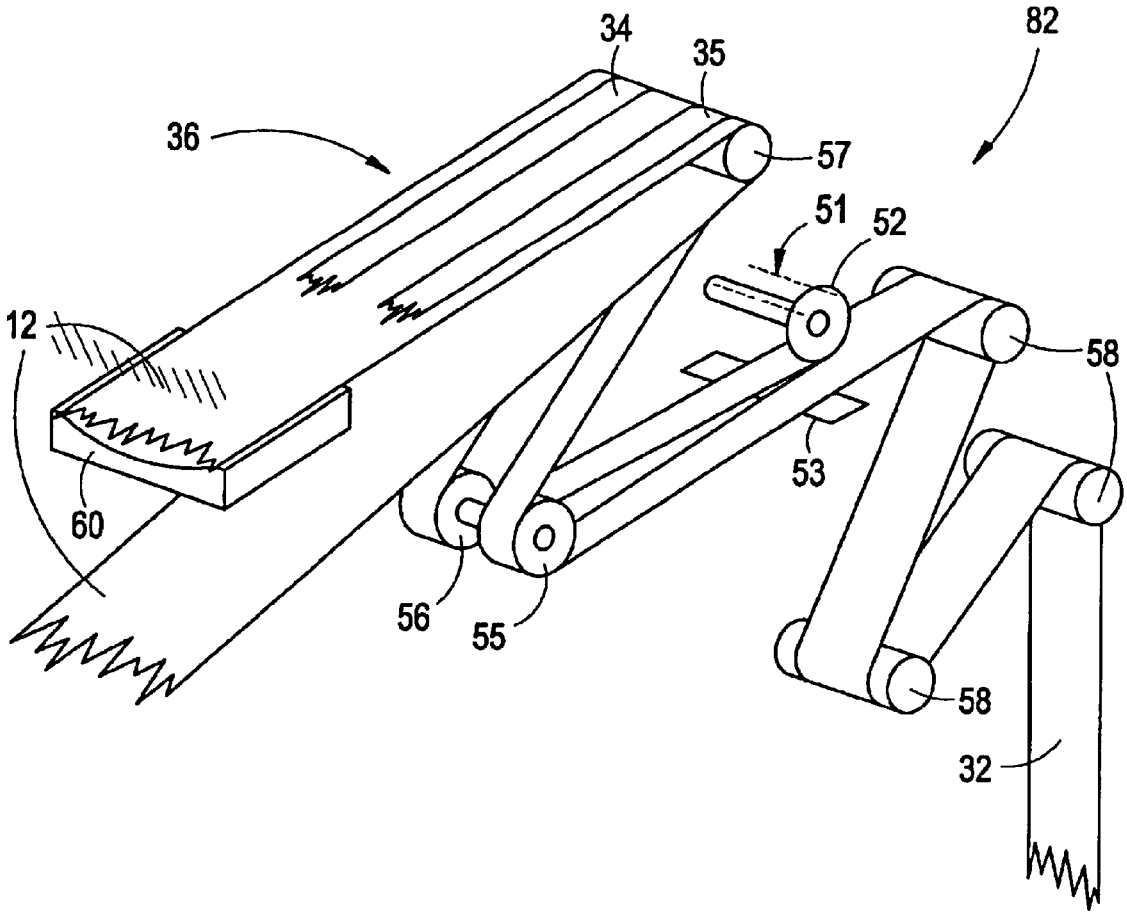
FIG. 10 is a perspective view of an alternative embodiment of the cigarette wrapper formation point of a cigarette making machine for use with the present invention.

Turning to FIG. 10, an alternative embodiment for the paper feeding assembly 82 is shown. In this embodiment, the outer wrap 12 is fed from a standard position to bullet roller 57 which directs the cigarette wrappers to the garniture 60 for formation of the cigarette. In this instance, the outer wrap 12 may be standard 27 mm wide cigarette paper and have normal porosity as well as other typical additives. As is depicted, the combined partial double wrap 36 which may be combined prior to the garniture is formed from the combination of the outer wrap 12 and the dual line inner wrap strips 34, 35.

As can be seen, the inner wrap strip paper 32 from the bobbin is fed to the guide rollers 58 prior to cutting or slitting by rotary cutter 51. The rotary cutter may be comprised of a rotary knife 52 and knife block 53. In such a formation, it is desirable to have a 8 mm wide combined portion of the interior of the cigarette covered with the partial double inner wrap, an inner wrap 32 may be provided which is slit in half forming equal 4 mm wide strips 34, 35. These strips may be formed by rotary cutter 51 and separated by separation rollers 55, 56 before the partial inner wrap strip 34, 35 are combined with the outer wrap paper 12 at the roller 57. The inner wrap 32 of course may be slit into even narrower strips for overlaying onto the outer wrap.

A benefit of such a design is that a rotary cutter 51 may be provided for slitting the paper into the desired widths. Problematic in handling narrow strips thereby necessitating the guide and tensioning rollers is that after the narrower strips are formed, care must be provided to prevent tearing of the inner wrap paper 32 and individual strips 34, 35. Thus, it may be beneficial to provide a rotary cutter 51 at a point which is fairly close or adjacent to the garniture 60 in order to prevent significant handling of the narrow inner wrap strips 34, 35.

In the paper feeding assembly 82 shown in FIG. 10, a rotary cutter 51 is shown to form the strips 34, 35 from the original web of material 32. A number of different cutting devices or slitters may be used in all of these embodiments such as a static knife, laser, rotary knife as depicted, water jet cutter, kiss cutting or micro-perforation formation. Additionally, pre-formed webs of material may be provided which are pre-cut into individual strips which may then be separated prior to feeding into the garniture through various handling devices. A number of differing embodiments may be utilized in order to feed the appropriate inner wrap strips into the garniture in combination with the outer wrap. While the various embodiments disclosed herein teach specific structure to accomplish the feeding of the inner wrap strips to the garniture, a number of embodiments may be provided for formation or supplying of the inner wrap strips to the garniture in combination with the outer wrap. Such variations are felt to fall within the teachings of the present application and no unnecessary limitation is to be interpreted from the specific examples of the paper feeding assembly setforth herein.

Figure 11:
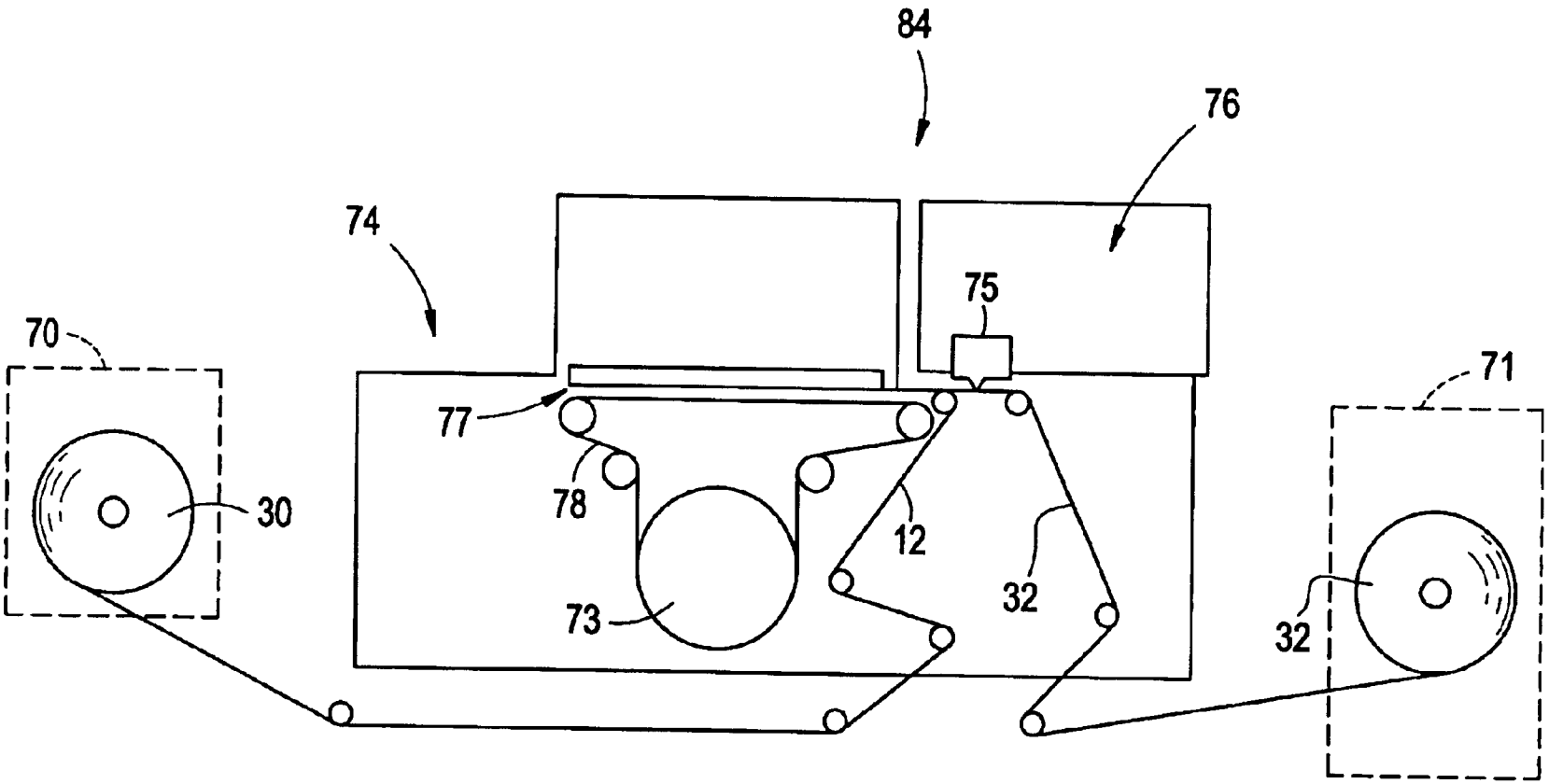
FIG. 11 is a side view of an alternative embodiment for formation of the cigarette wrapper for use with the present invention.

As disclosed in FIG. 11, an additional embodiment 84 is provided wherein a cigarette maker 74 may have external bobbin units 70, 71. External bobbin unit 70 may have bobbin 30 which supplies the outer wrap paper to be fed into the garniture 77. The bobbin 30 provides a web of material 12 which is fed into the garniture and combined with a web of material 32 which forms the inner wrap strips. External bobbin unit 71 may have a bobbin of material 32 which is fed to a knife mechanism 75 for slitting. The slitter or cutting mechanism 75 is positioned directly adjacent to the garniture 77 in order to decrease the length of handling of the individual narrow inner wrap strips. As shown, the maker 74 has garniture 77 and garniture belt 78 driven by drive shaft 73 which feeds the paper and tobacco material through the garniture during the cigarette formation process such that the tobacco rod and cigarette is formed with the inner wrap strips formed therein.

As may be appreciated, provision for an external bobbin unit 70, 71 for both the outer wrap and inner wrap material allows for easier online processing of the paper and ready integration into the cigarette maker 74 of the partial inner wrap strips. Additionally, external placement of the outer wrap bobbin 30 and inner wrap bobbin 32 requires minimal changing of the structure for the cigarette maker 74 as the bobbins may be spaced away from the maker 74 and no significant changes are required at the area around the garniture 77 apart from the guide and tensioning rollers. Additionally, external bobbin units are currently implemented with cigarette makers and may be provided for in order to combine the outer and partial inner wrap strips of the present invention in order to create the appropriate burn rate modification desired.

In use, the external unit 71 may be fitted with a spool of bandcast material instead of a standard bobbin of cigarette wrapper. A spool may be utilized due to the non-uniformity of the material in bandcast. A spool having bandcast recon may be used wherein the material is 8 mm in width and is fed into the maker 74 through guide rollers in order to minimize movement of the bandcast material as the spool is unwound. The material may be slit immediately prior to joining with the outer wrap material at the bullet roller which is the roller typically found at the first or beginning part of the garniture. A plurality of guide rollers and tensioning rollers may be provided to properly feed the material to the garniture and combine it with the outer wrap material.

The cigarette with burn rate modification of the present invention may be designed with variations in outer wrap and inner wrap paper characteristics. As previously explained, standard outer wrap designs are such that the typical outer wrap has a linear laid out width of 27 mm and generally a porosity of between 15 and 80 Coresta units. As is generally understood, significantly decreasing the outer wrap porosity changes the deliveries and linear burn rate of the cigarette. Modification of the standard burn rate for a normal or typical cigarette may be obtained through addition of a partial inner wrap to the cigarette. The partial inner wrap may be a single inner wrap portion or may be a plurality of inner wrap strips as shown in the various figures. The partial inner wrap may have paper characteristics with a significantly reduced porosity such that the inner wrap paper exhibits a porosity of less than 8 Coresta units. If a single inner wrap strip is utilized, such as with band cast or other paper as previously described and depicted in FIG. 6, the inner wrap layer may have a width of between 2–15 mm. The porosity of the inner wrap layer may be adjusted from any where to 0 to 8 Coresta units.

EXAMPLES

Several product examples were made using the construction of a partial strip wrap or partial inner wrap cigarette using the inventive techniques and construction described herein. In the examples, a control cigarette was used having no partial inner wrap strips which exhibited a linear burn rate of between 4.3–4.7 mm/min. Different materials where utilized, as detailed in the chart below, for the partial inner wrap strips ranging from standard treated paper to band cast tobacco material.

Examples of cigarettes with two band cast inner wrap strips having a porosity of band cast material less than 5 CORESTA units:

| Cig. | Outer Wrapper Porosity CORESTA | Outer Wrap Citrate % | Inner Strips Number | Inner Strip Width mm | Linear Burn Rate (LBR) mm/min | Self Extinguishment On 10 layers % |
|---|---|---|---|---|---|---|
| 1 | 50 | 0.5 | 0 | 0 | 4.3 | 0 |
| 2 | 50 | 0.5 | 2 | 4 | 3.1 | 100 |
| 3 | 50 | 0.5 | 2 | 5 | 2.6 | 100 |
| 4 | 50 | 0.5 | 2 | 6 | 2.7 | 100 |
| 5 | 40 | 0.7 | 0 | 0 | 4.7 | 0 |
| 6 | 40 | 0.7 | 2 | 3 | 3.8 | 48 |
| 7 | 30 | 0.6 | 0 | 0 | 4.3 | 0 |
| 8 | 30 | 0.6 | 2 | 4 | 3.1 | 100 |

Examples of cigarettes with two cigarette paper strips treated or covered with sodium alginate having a porosity of inner strip paper less than 5 CORESTA units:

| Cig. | Outer Wrapper Porosity CORESTA | Outer Wrap Citrate % | Inner Strips Number | Inner Strip Width mm | Linear Burn Rate (LBR) mm/min | Self Extinguishment On 10 layers % |
|---|---|---|---|---|---|---|
| 9 | 70 | 0.6 | 0 | 0 | 4.4 | 0 |
| 10 | 70 | 0.6 | 2 | 2 | 3.8 | 25 |

Examples of cigarettes detailing smoke deliveries of two samples with band cast strips:

| Cig | Outer Wrapper Porosity CORESTA | Outer Wrap Citrate % | Inner Strip Number | Inner Strip Width mm | Linear Burn Rate (LBR) mm/min | Self Extinguishment On 10 layers % | tar mg/cig | Nicotine mg/cig | CO mg/cig | Puff Number |
|---|---|---|---|---|---|---|---|---|---|---|
| 11 | 70 | 0.6 | 2 | 4 | 3.9 | 90 | 15.5 | 1.4 | 12.2 | 10.3 |
| 12 | 50 | 0.5 | 2 | 4 | 3.8 | 90 | 14.5 | 0.9 | 14.6 | 7.3 |

In the examples presented, it is apparent that the addition of the partial inner wrap to the cigarette had a definite impact on linear burn rate and self extinguishment as compared to the control cigarette. The linear burn rate for the cigarettes using the present invention was directly affected and evidenced a reduction in linear burn rate by up to 40 percent. Where inner wrap strips were utilized having a width of at least 4 mm, all test samples self extinguished. Narrower width strips had differing results which could be modified by using alternative additives or increasing the number of strips. References to the self-extinguishment of the cigarette on 10 layers is related to the NIST test for flammability.

It is apparent that variations between the outer wrap and inner wrap porosity, width of the inner wrap, material used for the inner wrap and other factors will readily modify the burn rate of the cigarette, while still using concepts of the present invention. Such variations are deemed to fall within the teachings of the present application as generally, online addition of a partial inner wrap layer is described herein to properly modify the burn rate of a cigarette.

What is claimed is:

1. A cigarette with burn rate modification, comprising:

a tobacco column surrounded by an outer wrap paper;

a plurality of substantially equidistantly spaced partial inner wrap paper strips extending substantially along said tobacco column and coaxial to said tobacco column and positioned away from a seam of said outer wrap paper, said partial inner wrap strips being less than about 15 mm in width.

2. The cigarette of claim 1 wherein said outer wrap paper has a porosity of greater than about 15 Coresta Units and said partial inner wrap has a porosity of less than 10 Coresta Units.

3. The cigarette of claim 2 wherein said partial inner wrap strips have a porosity of less than 7 Coresta Units.

4. The cigarette of claim 2 wherein said partial inner wrap strips are a bandcast based tobacco material.

5. The cigarette of claim 4 wherein said partial inner wrap strips are between about 2 mm and 15 mm in width and has a porosity of less than 1 Coresta Unit.

6. The cigarette of claim 2 wherein said partial inner wrap strips are a reconstituted tobacco material.

7. The cigarette of claim 2 wherein said partial inner wrap strips are a polymer based material.

8. The cigarette of claim 1 wherein said plurality of strips is a first and said second inner wrap strip are each about 4 mm or less in linear width.

9. A partial double wrap cigarette, comprising:

an outer wrap layer circumscribing a tobacco column;

a plurality of partial inner wrap paper layers coaxial to said tobacco column, said plurality of partial inner wrap layers extending along the length of said tobacco column substantially equidistantly spaced apart and positioned away from a seam area of said outer wrap layer;

wherein said partial inner wrap layer covers 60% or less of the circumference of said tobacco column.

10. A partial double wrap cigarette, comprising:

an outer wrap layer circumscribing a tobacco column and having an over wrap seam;

a plurality of partial inner wrap paper layers coaxial to said tobacco column, said partial inner wrap layers extending along the length of said tobacco column and substantially equidistantly spaced around said tobacco column away from said over wrap seam;

wherein each of said partial inner wrap layers is less than 15 mm in width.

11. The partial double wrap cigarette of claim 10 wherein each of said partial inner wrap layers have a width between 2 and 15 mm.

12. The partial double wrap cigarette of claim 11 wherein said partial inner wrap layers are a bandcast tobacco material.

13. The partial double wrap cigarette of claim 11 wherein said partial inner wrap layers are a low porosity paper.

14. The partial double wrap cigarette of claim 11 wherein said partial inner wrap layers have a porosity of less than 7 Coresta Units.

15. The partial double wrap cigarette of claim 14 wherein partial inner wrap layers extends from an open end of said cigarette to a filter at an opposite distal end.

16. The partial double wrap cigarette of claim 11 wherein each of said plurality of partial inner wrap layers have a porosity of less than 7 Coresta Units.

17. A cigarette with burn rate modification, comprising:

a tobacco column surrounded by an outer wrap paper;

a plurality of partial inner wrap paper layers adjacent said tobacco column and coaxially extending along said column and equidistantly spaced around said column and away from an outer wrap seam;

said cigarette having a plurality of coaxially extending high diffusion areas and a plurality of coaxially extending low diffusion areas.

18. The cigarette with burn rate modification of claim 17 wherein said plurality of coaxially extending low diffusion areas are aligned with said a plurality of partial inner wrap layers, each of said inner wrap layers having a porosity of less than about 7 Coresta Units.

19. The cigarette with burn rate modification of claim 17 wherein said plurality of said partial inner wrap layers are, in combination, a total of about 8 mm in width.

20. The cigarette with burn rate modification of claim 17 wherein said coaxially extending low diffusion areas are is aligned with said partial inner wrap layers.

21. The cigarette with burn rate modification of claim 20 wherein the total of said low diffusion area is less than about 12 mm in width.

22. The cigarette with burn rate modification of claim 20 wherein said partial inner wrap layers are a strip of bandcast tobacco, said strip being less than 12 mm in width, said partial inner wrap layers have a porosity of less than 7 Coresta units, said strip extending from an open end of said tobacco column to a filter at an opposite distal end of said tobacco column.

23. A cigarette with burn rate modification, comprising:

a tobacco column surrounded by an outer wrap paper and forming an outer wrap seam;

a plurality of partial inner wrap paper strips adjacent said tobacco column and spaced apart about said column away from said outer wrap seam, said plurality of partial inner wrap strips extending substantial coaxially along said tobacco column;

said cigarette having a plurality of coaxially extending high diffusion areas and a plurality of coaxially extending low diffusion areas;

wherein said coaxially extending low diffusion areas are aligned with said plurality of partial inner wrap strips, each of said strips being narrow paper strips having a porosity of less than 7 Coresta units, said outer wrap paper having a porosity of more than 12 Coresta units.

24. A cigarette having a reduced linear burn rate, comprising:

a tobacco column surrounded by a wrapper, said wrapper having a first porosity and forming an overwrap seam;

a plurality of strips of paper material interposed between said wrapper and said tobacco column and spaced about said tobacco column and having a second porosity, said plurality of strips of paper positioned away from said overwrap seam and extending coaxially along said tobacco column;

said first porosity is greater than said second porosity, said cigarette having a linear burn rate of less than about 4 mm per minute, wherein at least one of said strips of paper material is a strip of bandcast tobacco, said strip of bandcast tobacco having a width of less than 6 mm and having a porosity of less than 4 Coresta Units.

* * * * *